US005516484A

United States Patent [19]

Kubosono et al.

[11] Patent Number: 5,516,484

[45] Date of Patent: May 14, 1996

[54] COPPER-NICKEL-TIN BASED ALLOY

[75] Inventors: Kenji Kubosono; Iwao Asamizu; Masazumi Iwase; Toshihiro Kurita, all of Sagamihara, Japan

[73] Assignee: Mitsubishi Denki Kabushiki Kaisha, Tokyo, Japan

[21] Appl. No.: 384,872

[22] Filed: Feb. 7, 1995

Related U.S. Application Data

[62] Division of Ser. No. 903,968, Jun. 26, 1992, Pat. No. 5,441,696.

[30] Foreign Application Priority Data

Jul. 9, 1991 [JP] Japan ..... 3-168230

[51] Int. Cl.[6] ..... C22C 9/00

[52] U.S. Cl. ..... 420/469; 148/433; 148/435; 420/470; 420/472; 420/473; 420/485; 420/487; 420/490; 420/493; 420/499

[58] Field of Search ..... 420/469, 470, 420/472, 473, 485, 487, 488, 490, 492, 493, 499, 590; 148/412, 414, 433, 435

[56] References Cited

U.S. PATENT DOCUMENTS 5,019,185 5/1991 Nakajima et al. ..... 420/488
5,028,282 7/1991 Kubozono et al. ..... 420/473

*Primary Examiner*—David A. Simmons
*Assistant Examiner*—Robert R. Koehler
*Attorney, Agent, or Firm*—Oblon, Spivak, McClelland, Maier & Neustadt

[57] ABSTRACT

A copper-nickel based alloy, having reduced break-out during casting and reduced cracking during processing in solid state, which consists essentially of 3.1 to 25 wt. % of Ni, 0.1 to 1.5 wt. % of Mn, 0.0001 to 0.0093 wt. % of B, 0.01 to 0.7 wt. % of Si, and from 3 to 10 wt. % of Sn and the remainder being Cu and unavoidable elements.

3 Claims, No Drawings

COPPER-NICKEL-TIN BASED ALLOY

This is a division of application Ser. No. 07/903,968 filed on Jun. 26. 1992, now U.S. Pat. No. 5,441,696.

BACKGROUND OF THE INVENTION

1. Field of Use

The present invention relates to copper-nickel based alloys (hereinafter, it may be referred to as "Cu-Ni based alloys"). More particularly, the present invention relates to Cu-Ni based alloys such as Cu-Ni-Zn alloys, Cu-Ni-Sn alloys, Cu-Ni-Si alloys and Cu-Ni-Al alloys, which are useful for electronic parts.

2. Description of the Background

Heretofore, as the Cu-Ni based alloy, there have been nickel silver or a Cu-Ni-Zn alloy which has been known for a long time, a Cu-Ni-Si alloy which is commonly called as Corson alloy, a Cu-Ni-Sn alloy which utilizes spinodal decomposition, and the like. They have been very much used as material for electronic parts.

The above-mentioned Cu-Ni based alloy was formerlly produced by mold-casting followed by forging, and has been used as expanded material. Recently, continuous casting has been applied thanks for development of technology. However, conventional Cu-Ni based alloys have problems such as their inferior in casting properties, particularly horizontal continuous casting properties.

As the problems in the horizontal continuous casting of the Cu-Ni based alloy as mentioned above, the following drawbacks may be mentioned:

The life of graphite used as mold is very short;

surface texture of ingot during the casting step becomes degraded, whereby commercialization is difficult;

ingot breaks out; and cracks arise in the first rolling step of ingot.

SUMMARY OF THE INVENTION

It is an object of the present invention to solve such problems and provide a Cu-Ni based alloy in which the break out of ingot and cracks in the processing step are improved and which is excellent in casting properties, particularly horizontal continuous casting properties and processability.

DETAILED DESCRIPTION OF THE PREFERRED EMBODIMENT

The copper-nickel based alloy of the present invention is as follows.

(1) A copper-nickel based alloy comprises 3 to 25 wt. % of Ni, 0.1 to 1.5 wt. % of Mn, 0.0001 to 0.01 wt. % of B and the rest being Cu and an unavoidable element.

(2) The copper-nickel alloy of above (1) further contains 0.01 to 0.7 wt. % of Si.

(3) The copper-nickel based alloy of above (1) or (2), contains, as metal element other than Cu, Ni, Mn and B, at least one element selected from the group consisting of Zn, Sn and Al in an amount of not more than 30 wt. %, 10 wt. % and 6 wt. %, respectively.

(4) The copper-nickel based alloy of above (1), (2) or (3), contains, no more than 0.02 wt. % of P.

The Cu-Ni based alloy of the present invention is an alloy having Mn (manganese) and B (boron) added as addition component to a Cu-Ni binary alloy consisting of Cu and Ni or Cu-Ni based alloy such as ternary alloy, quaternary alloy and more than quaternary alloy consisting of Cu, Ni and other metal elements. Mn is added as deoxidizer and also in order to improve heat resistance. Further, by adding B, quality of ingot is improved and casting properties particularly horizontal continuous casting properties is considerably improved.

According to the present invention, in addition to Mn and B, Si (silicon) may be added. By adding Si, the life of graphite mold can be improved due to the synergistic effect of B and Si. As other metal elements as mentioned above, for example, Zn, Sn and Al may be mentioned, and at least one element can be incorporated. As specific examples for the Cu-Ni based alloy containing such other metal elements, a ternary alloy such as Cu-Ni-Zn, Cu-Ni-Sn or Cu-Ni-Al; and a quaternary alloy such as Cu-Ni-Zn-Sn, Cu-Ni-Zn-Al or Cu-Ni-Sn-Al may be mentioned.

In a Cu-Ni based alloy as in the present invention, a trace amount of P may be contained during the production step. Inclusion of P results in decrease of ingot quality and considerable adverse effects in ingot processability. Thus, it is preferred that the Cu-Ni based alloy of the present invention does not contain P at all. Even though the alloy contains P, the content of P should be made as small as possible. By making the content of P no more than 0.2 wt. %, the quality and processability of ingot can be maintained at a high level.

A Cu-Ni-Zn alloy hardly changes its color and is excellent in environmental resistance as well as heat resistance. A Cu-Ni-Sn alloy and Cu-Ni-Al alloy have high strength and are excellent in stress corrosion resistance. By adding B to such a Cu-Ni based alloy which has the above-mentioned advantages, the casting properties of the alloy are improved without impairing the advantages of the alloy.

The content of each component in the Cu-Ni based alloy of the present invention is 3–25 wt. % of Ni, 0.1–1.5 wt. % of Mn, 0.0001–0.01 wt. % of B and the rest being Cu and an unavoidable element. Further, in a case containing Si, the content of Si ranges from 0.01 to 0.7 wt. %. In a case containing other metal element than Cu, Ni, Mn, B and Si, the content of Zn as the other metal element is not more than 30 wt. %, preferably 10–30 wt. %, the content of Sn as the other metal element is less than 10 wt. %, preferably 3–10 wt. %, and the content of Al as the other metal element is not more than 6 wt. %, preferably 1–6 wt. %. All the other metal elements contribute to improve the strength of the copper-nickel based alloy. The more the content, the greater the effects. On the other hand, as the content is increased, the processability is considerably deteriorated. Thus, the upper limit of the content is determined to be the maximum value until which each component can be a state of solid solution in the copper-nickel based alloy.

If the content of B is less than 0.0001 wt. %, the improvement of the quality of ingot is small. On the other hand, if the amount exceeds 0.01 wt. %, cracks appears in the surface of ingot, such being undesirable.

If the content of Si is less than 0.01 wt. %, the synergistic effects with B is small. If the content exceeds 0.7 wt. %, the processability of ingot is deteriorated, such being undesirable.

The Cu-Ni based alloy of the present invention can be produced by blending starting materials to have each content as mentioned above and melting these starting materials.

The Cu-Ni based alloy of the present invention can be used in the same field as in conventional Cu-Ni based alloy, and in particular is suitably used as material for electronic parts such as connector, switch, volume, relay and brush for micromotor.

Now, the present invention will be described with reference to Examples and Comparative Examples.

Starting materials were blended to have the composition as shown in Tables 1–6 and melted to obtain copper-nickel based alloys of the present invention and comparison, followed by horizontal continuous casting by using graphite mold. Comparison between the alloys of the present invention and the comparative alloys were made. The size of ingot was 1.5 mm of thickness×450 mm of width.

The composition of the Cu-Ni based alloys tested, the casting amount until break out occurs in a mold and quality and processability of ingot are shown in Tables 1–6.

TABLE 1

| Sample | Composition (wt %) | | | | | | | | | Casting amount per | Ingot | Processa-bility, | |
|---|---|---|---|---|---|---|---|---|---|---|---|---|---|
| No. | Ni | Mn | B | Si | P | Zn | Sn | Al | Cu | mold (ton) | quality | etc. | Remark |
| 1 | 3.2 | 0.11 | 0.00003 | — | — | — | — | — | the rest | 2.3 | Pass | Pass | Comparative alloy |
| 2 | 3.1 | 0.13 | 0.00011 | — | — | — | — | — | the rest | 5.8 | Pass | Pass | Alloy of the present invention |
| 3 | 3.3 | 0.12 | 0.0032 | — | — | — | — | — | the rest | 8.5 | Pass | Pass | Alloy of the present invention |
| 4 | 3.1 | 0.13 | 0.0093 | — | — | — | — | — | the rest | at least 10 | Pass | Pass | Alloy of the present invention |
| 5 | 3.2 | 0.11 | 0.0123 | — | — | — | — | — | the rest | 7.5 | *3 | *1 | Comparative alloy |
| 6 | 3.3 | 1.43 | 0.0038 | — | — | — | — | — | the rest | at least 10 | Pass | *2 | Alloy of the present invention |
| 7 | 3.1 | 1.86 | 0.0083 | — | — | — | — | — | the rest | at least 10 | Pass | Fine cracks appeared | Comparative alloy |
| 8 | 12.6 | 0.23 | 0.0008 | — | — | — | — | — | the rest | at least 10 | Pass | Pass | Alloy of the present invention |
| 9 | 24.3 | 0.26 | 0.00005 | — | — | — | — | — | the rest | 1.8 | Pass | Pass | Comparative alloy |
| 10 | 24.6 | 0.25 | 0.00014 | — | — | — | — | — | the rest | 7.2 | Pass | Pass | Alloy of the present invention |
| 11 | 24.9 | 0.23 | 0.0092 | — | — | — | — | — | the rest | at least 10 | Pass | Pass | Alloy of the present invention |
| 12 | 24.7 | 0.26 | 0.0136 | — | — | — | — | — | the rest | at least 10 | *3 | *1 | Comparative alloy |

*1: Cracks appeared in the first rolling.
*2: Fine cracks appeared partially but commercialization was possible.
*3: Fine cracks appeared on the surface.

TABLE 2

| Sample | Composition (wt %) | | | | | | | | | Casting amount per | Ingot | Processa-bility, | |
|---|---|---|---|---|---|---|---|---|---|---|---|---|---|
| No. | Ni | Mn | B | Si | P | Zn | Sn | Al | Cu | mold (ton) | quality | etc. | Remark |
| 13 | 27.6 | 0.28 | 0.0122 | 0.016 | — | — | — | — | the rest | at least 10 | *3 | *1 | Comparative alloy |
| 14 | 3.3 | 0.12 | — | 0.013 | — | — | — | — | the rest | 2.6 | Pass | Pass | Comparative alloy |
| 15 | 3.2 | 0.14 | 0.00014 | 0.012 | — | — | — | — | the rest | at least 10 | Pass | Pass | Alloy of the present invention |
| 16 | 3.3 | 0.11 | — | 0.65 | — | — | — | — | the rest | 3.0 | Pass | Pass | Comparative alloy |
| 17 | 3.1 | 0.15 | 0.0083 | 0.68 | — | — | — | — | the rest | at least 10 | Pass | Pass | Alloy of the present invention |
| 18 | 3.4 | 0.13 | 0.0092 | 0.83 | — | — | — | — | the rest | 8.2 | Pass | *1 | Comparative alloy |
| 19 | 24.3 | 0.32 | — | 0.62 | — | — | — | — | the rest | 2.5 | Pass | *1 | Comparative alloy |
| 20 | 24.6 | 0.32 | 0.0085 | 0.63 | — | — | — | — | the rest | at least 10 | Pass | *2 | Alloy of the present invention |

TABLE 2-continued

| Sample No. | Composition (wt %) Ni | Mn | B | Si | P | Zn | Sn | Al | Cu | Casting amount per mold (ton) | Ingot quality | Processa-bility, etc. | Remark |
|---|---|---|---|---|---|---|---|---|---|---|---|---|---|
| 21 | 24.8 | 0.33 | 0.0088 | 0.93 | — | — | — | — | the rest | at least 10 | *4 | *1 | Comparative alloy |

*1: Cracks appeared in the first rolling.
*2: Fine cracks appeared partially but commercialization was possible.
*3: Fine cracks appeared on the surface.
*4: Cracks appeared on the surface.

TABLE 3

| Sample No. | Composition (wt %) Ni | Mn | B | Si | P | Zn | Sn | Al | Cu | Casting amount per mold (ton) | Ingot quality | Processa-bility, etc. | Remark |
|---|---|---|---|---|---|---|---|---|---|---|---|---|---|
| 22 | 3.1 | 0.33 | 0.0015 | — | 0.018 | — | — | — | the rest | 8.5 | Pass | Pass | Alloy of the present invention |
| 23 | 3.3 | 0.29 | 0.0018 | — | 0.026 | — | — | — | the rest | 7.8 | Pass | *1 | Comparative alloy |
| 24 | 24.6 | 0.28 | 0.0016 | — | 0.003 | — | — | — | the rest | at least 10 | Pass | Pass | Alloy of the present invention |
| 25 | 24.1 | 0.31 | 0.0019 | — | 0.017 | — | — | — | the rest | at least 10 | Pass | Pass | Alloy of the present invention |
| 26 | 24.5 | 0.33 | 0.0018 | — | 0.029 | — | — | — | the rest | at least 10 | Pass | *1 | Comparative alloy |
| 27 | 23.9 | 0.31 | 0.0018 | 0.013 | 0.016 | — | — | — | the rest | at least 10 | Pass | *2 | Alloy of the present invention |
| 28 | 24.6 | 0.28 | 0.0020 | 0.016 | 0.025 | — | — | — | the rest | at least 10 | Pass | *1 | Comparative alloy |
| 29 | 24.7 | 0.27 | 0.0019 | 0.65 | 0.015 | — | — | — | the rest | at least 10 | Pass | Pass | Alloy of the present invention |
| 30 | 24.9 | 0.26 | 0.0017 | 0.63 | 0.031 | — | — | — | the rest | 8.2 | Pass | *1 | Comparative alloy |

*1: Cracks appeared in the first rolling.
*2: Fine cracks appeared partially but commercialization was possible.

TABLE 4

| Sample No. | Composition (wt %) Ni | Mn | B | Si | P | Zn | Sn | Al | Cu | Casting amount per mold (ton) | Ingot quality | Processa-bility, etc. | Remark |
|---|---|---|---|---|---|---|---|---|---|---|---|---|---|
| 31 | 17.8 | 0.53 | — | — | — | 10.8 | — | — | the rest | 2.8 | Pass | Pass | Comparative alloy |
| 32 | 18.0 | 0.48 | 0.00013 | — | — | 10.7 | — | — | the rest | at least 10 | Pass | Pass | Alloy of the present invention |
| 33 | 17.9 | 0.47 | 0.00015 | 0.012 | 0.007 | 28.6 | — | — | the rest | at least 10 | Pass | Pass | Alloy of the present invention |
| 34 | 18.1 | 0.51 | 0.00002 | 0.016 | 0.0006 | 28.9 | — | — | the rest | 2.6 | Pass | Pass | Comparative alloy |
| 35 | 18.1 | 0.49 | 0.0087 | 0.54 | — | 29.1 | — | — | the rest | 9.2 | Pass | *2 | Alloy of the present invention |
| 36 | 18.0 | 0.47 | 0.0133 | 0.49 | 0.028 | 28.6 | — | — | the rest | 6.3 | *4 | *1 | Comparative alloy |

*1: Cracks appeared in the first rolling.
*2: Fine cracks appeared partially but commercialization was possible.
*4: Cracks appeared on the surface.

TABLE 5

| Sample No. | Composition (wt %) Ni | Mn | B | Si | P | Zn | Sn | Al | Cu | Casting amount per mold (ton) | Ingot quality | Processa-bility, etc. | Remark |
|---|---|---|---|---|---|---|---|---|---|---|---|---|---|
| 37 | 3.3 | 0.32 | 0.00013 | 0.012 | — | — | 3.5 | — | the rest | at least 10 | Pass | Pass | Alloy of the present invention |
| 38 | 9.1 | 0.33 | — | — | — | — | 6.1 | — | the rest | 2.5 | Pass | Pass | Comparative alloy |
| 39 | 9.2 | 0.31 | 0.00012 | — | — | — | 6.0 | — | the rest | at least 10 | Pass | Pass | Alloy of the present invention |
| 40 | 9.0 | 0.29 | 0.00013 | 0.013 | — | — | 5.9 | — | the rest | at least 10 | Pass | Pass | Alloy of the present invention |
| 41 | 9.1 | 0.30 | 0.00011 | 0.012 | 0.019 | — | 6.1 | — | the rest | at least 10 | Pass | *2 | Alloy of the present invention |
| 42 | 9.0 | 0.33 | 0.00014 | 0.016 | 0.031 | — | 6.0 | — | the rest | 6.5 | *4 | *1 | Comparative alloy |
| 43 | 9.1 | 0.36 | 0.0089 | 0.053 | 0.002 | — | 5.9 | — | the rest | 8.5 | Pass | *2 | Alloy of the present invention |
| 44 | 9.2 | 0.33 | 0.0136 | — | 0.023 | — | 6.0 | — | the rest | 6.6 | *4 | *1 | Comparative alloy |
| 45 | 21.2 | 0.31 | 0.00013 | 0.012 | 0.001 | — | 4.9 | — | the rest | at least 10 | Pass | Pass | Alloy of the present invention |
| 46 | 22.3 | 0.28 | 0.0078 | 0.010 | — | — | 5.0 | — | the rest | at least 10 | Pass | *2 | Alloy of the present invention |
| 47 | 21.6 | 0.30 | 0.0162 | — | — | — | 5.0 | — | the rest | 6.2 | *4 | *1 | Comparative alloy |

*1: Cracks appeared in the first rolling.
*2: Fine cracks appeared partially but commercialization was possible.
*4: Cracks appeared on the surface.

TABLE 6

| Sample No. | Composition (wt %) Ni | Mn | B | Si | P | Zn | Sn | Al | Cu | Casting amount per mold (ton) | Ingot quality | Processa-bility, etc. | Remark |
|---|---|---|---|---|---|---|---|---|---|---|---|---|---|
| 48 | 12.5 | 0.23 | — | — | — | — | — | 1.2 | the rest | 3.0 | Pass | Pass | Comparative alloy |
| 49 | 12.6 | 0.25 | 0.00015 | — | — | — | — | 1.2 | the rest | 8.5 | Pass | Pass | Alloy of the present invention |
| 50 | 12.3 | 0.26 | 0.0076 | — | — | — | — | 5.8 | the rest | 7.2 | Pass | *2 | Alloy of the present invention |
| 51 | 12.4 | 0.23 | 0.0154 | — | — | — | — | 5.9 | the rest | 4.3 | *3 | *1 | Comparative alloy |
| 52 | 9.2 | 0.33 | 0.00016 | — | — | 18.6 | — | 1.2 | the rest | at least 10 | Pass | Pass | Alloy of the present invention |
| 53 | 9.1 | 0.29 | 0.00013 | — | — | — | 6.1 | 1.3 | the rest | at least 10 | Pass | Pass | Alloy of the present invention |
| 54 | 8.9 | 0.31 | 0.00015 | 0.012 | 0.006 | 10.6 | 3.2 | — | the rest | at least 10 | Pass | Pass | Alloy of the present invention |
| 55 | 9.3 | 0.33 | 0.00022 | 0.016 | 0.003 | 12.3 | — | 1.5 | the rest | at least 10 | Pass | Pass | Alloy of the present invention |
| 56 | 9.1 | 0.31 | 0.00016 | 0.011 | 0.001 | — | 9.1 | — | the rest | 8.6 | Pass | *2 | Alloy of the present invention |
| 57 | 9.1 | 0.32 | 0.00011 | 0.006 | — | — | 5.9 | — | the rest | 4.3 | Pass | Pass | Comparative alloy |

*1: Cracks appeared in the first rolling.
*2: Fine cracks appeared partially but commercialization was possible.
*3: Fine cracks appeared on the surface.

It is clear from the results in Tables 1–6 that the trace components of B, Si and P considerably affect the casting properties in the Cu-Ni based alloy.

With respect to B, as seen from the comparison between Sample No. 1 and No. 2, No. 9 and No. 10, No. 14 and No. 15, No. 31 and No. 32, No. 33 and No. 34, No. 38 and No. 39, No. 48 and No. 49, etc., if the content of B is at least 0.0001 wt. %, the casting amount until break out is large and the quality of ingot and processability are superior. Further, as seen from the comparison between Sample No. 4 and No. 5, No. 11 and No. 12, No. 35 and No. 36, No. 43 and No. 44, No. 46 and No. 47, No. 50 and No. 51, etc., if the content of B is not more than 0.01 wt. %, the casting amount until break out is large and the quality of ingot and processability are superior.

With respect to Si, as seen from the comparison between Sample No. 14 and 15, No. 19 and No. 20, No. 2 and No. 15, etc., effects obtainable by addition of Si can not be recognized if no B is contained. On the other hand, the casting properties are improved if B is contained. Further, with respect to the content of Si, it is clear from the comparison between Sample Nos. 15 and 17 and No. 18, No. 20 and No. 21, etc., that good results can be obtained in a range of from 0.01 to 0.7 wt. %.

With respect to P, it is clear from the comparison between Sample No. 22–No. 30, No. 33–No. 36, No. 40– No. 45, etc., that the quality of ingot and excellent processability can be obtained by suppressing the content of P to a level of not more than 0.02% by weight.

With respect to Cu and Ni, as the content of Ni is increased, its contribution to strength is also increased in a copper-nickel based alloy. According to the present invention, the limit of these metal elements were determined based on the Examples. If the content of Ni exceeds 25%, the processability is deteriorated as shown in Sample No. 13 and damage of the oven and mold are substantial, whereby a refractory used for conventional casting of copper alloys can not endure and horizontal continuous casting per se is difficult.

The content of Mn is determined in view of the effects to stabilize the aging properties of a Cu-Ni-Sn based alloy which has age hardening properties (not less than 0.1 wt. %) and processability (not more than 1.5 wt. %). Mn contributes as deoxidizer to other copper-nickel based alloys and is generally added in an amount of from 0.2 to 0.6 wt. %. The range of the content is determined based on the Examples in relation to the other elements because Mn alone effects the casting properties and processability a little.

As described in the foregoing, in the Cu-Ni based alloy of the present invention, by adding Mn and B to a Cu-Ni alloy the surface roughness of ingot, break out of ingot and cracks appeared in the processing step in the Cu-Ni alloy can be improved, whereby the casting properties, particularly horizontal continuous casting properties and processability can be improved. As a result, reduction of production cost and improvement of productivity can be made.

According to the Cu-Ni based alloy of above (2), by further adding Si, the casting properties is further improved due to the synergistic effects with B.

According to the Cu-Ni based alloy of above (3), the casting properties and processability can be improved without impairing the advantages which Cu-Ni-Zn alloys, Cu-Ni-Sn alloys and Cu-Ni-Al alloys originally possess.

According to the Cu-Ni based alloy of above (4), the content of P is suppressed, whereby the processability is further improved.

What is claimed is:

1. A copper-nickel based alloy, which consists essentially of 3.1 to 25 wt. % of Ni, 0.1 to 1.5 wt. % of Mn, 0.0001 to 0.0093 wt. % of B, and 3 to 10 wt. % of Sn, wherein each of said elements above is in solid solution in said copper-nickel based alloy; and the remainder being Cu and unavoidable elements.

2. The alloy according to claim 1, which further comprises 0.01 to 0.7 wt. % of Si.

3. The alloy according to claim 1, which contains no more than 0.02 wt. % of P.

* * * * *